US008256933B1

(12) United States Patent
Taj

(10) Patent No.: US 8,256,933 B1
(45) Date of Patent: Sep. 4, 2012

(54) HEAT DISSIPATION APPARATUS FOR A LAMP

(75) Inventor: Aijaz Taj, Chino Hills, CA (US)

(73) Assignee: Lights of America, Inc., Walnut, CA (US)

( * ) Notice: Subject to any disclaimer, the term of this patent is extended or adjusted under 35 U.S.C. 154(b) by 325 days.

(21) Appl. No.: 12/584,233

(22) Filed: Sep. 2, 2009

(51) Int. Cl.
*F21V 29/00* (2006.01)

(52) U.S. Cl. ..... 362/345; 362/294; 362/373

(58) Field of Classification Search ..... 362/294, 362/345, 373, 580, 547, 126, 218, 264
See application file for complete search history.

(56) References Cited

U.S. PATENT DOCUMENTS

| | | | | |
|---|---|---|---|---|
| 2007/0253202 | A1* | 11/2007 | Wu et al. | 362/294 |
| 2008/0266866 | A1* | 10/2008 | Tsai | 362/294 |
| 2009/0135613 | A1* | 5/2009 | Peng | 362/373 |
| 2009/0268468 | A1* | 10/2009 | Liu | 362/294 |
| 2010/0097794 | A1* | 4/2010 | Teng et al. | 362/231 |
| 2010/0118541 | A1* | 5/2010 | Li | 362/294 |

* cited by examiner

*Primary Examiner* — Bao Q Truong
(74) *Attorney, Agent, or Firm* — Kuta IP Law LLC; Christine M. Kuta

(57) ABSTRACT

A heat dissipation apparatus for a light emitting diode (LED) lamp includes passive heat dissipation elements that enable the LED lamp to meet form factor standards while managing heat to optimize operation and lifespan of the LEDs. The heat dissipation apparatus includes a reflector dish that has surface area enhancement features. The heat dissipation apparatus is in thermal connection with the lamp LEDs. The heat dissipation apparatus further includes a heat pipe that further enhances the passive heat dissipation.

20 Claims, 7 Drawing Sheets

HEAT DISSIPATION APPARATUS FOR A LAMP

BACKGROUND

Solid state lighting has been developed to overcome some of the problems of incandescent lamps and gas discharge lamps. Solid state lighting (SSL) refers to a type of lighting that utilizes light-emitting diodes (LEDs), organic light-emitting diodes (OLED), or polymer light-emitting diodes (PLED) as sources of illumination rather than electrical filaments or gas. The term "solid state" refers to the fact that light in an LED is emitted from a solid object—a block of semiconductor—rather than from a vacuum or gas tube, as is the case in traditional incandescent light bulbs and fluorescent lamps. The LED is a semiconductor diode that emits incoherent narrow-spectrum light when electrically biased in the forward direction of the p-n junction, as in the common LED circuit resulting in electroluminescence. Its solid-state nature provides for greater resistance of LED lighting to shock, vibration, and wear, thereby increasing its lifespan significantly.

Many conventional LED devices, however, are limited by thermal energy-management issues. For example, LEDs exhibit negative temperature coefficient aspects. That is, at a fixed power input, as the LED device's operating heat rises, the LED device's light output decreases. High heat during use can shorten the useful life of an LED. It is, however, desirable to run LEDs using high current, because the higher the current, the higher the brightness of the emitted light. Ideally, the temperature measured at the LED leads is a maximum of 120-130 C. Accordingly, there is motivation to manage heat as much as possible in order to operate an LED optimally with regard to power input and light output and LED life.

Form factor standards have been established for lighting fixtures and typically it is desirable to design lamps that conform to the standards. Accordingly, LED lamps are typically required to conform to established size standards including size standards established for other lighting types such as incandescent lamps. The size standards often limit heat management solutions for LED lamps.

It remains desirable to have an LED illumination device wherein heat is managed such that lumens, energy consumption and lifespan are maximized preferably in a form factor conforming to an established standard.

SUMMARY

The present invention is directed to an apparatus for the dissipation of heat in an LED lamp. The heat dissipation apparatus includes a reflector dish that has surface area enhancement features. The heat dissipation apparatus is in thermal connection with the lamp LEDs. The heat dissipation apparatus further includes a heat pipe that further enhances the passive heat dissipation.

In a first embodiment, a heat dissipation device for an LED lamp includes a heat dissipation disk in thermal connection with at least one LED in the lamp, and a reflector dish having at least one surface area enhancement feature in thermal connection with the heat dissipation disk, and a heat pipe in thermal connection with the heat dissipation disk. The surface enhancement features improve thermal management in the lamp without altering its form factor.

In a first arrangement, the at least one surface area enhancement feature is a ripple in the reflector dish. In a second arrangement, the at least one surface area enhancement feature is a plurality of flanges extending from the rim of the reflector dish. In a third arrangement, the at least one surface area enhancement feature is a plurality of ripples in the reflector dish.

The heat dissipation device further includes a thermally conductive housing containing the heat dissipation disk, reflector dish and heat pipe. In some arrangements, the heat dissipation disk, reflector dish and heat pipe are mounted in the housing with thermally conductive adhesive. In a further alternative arrangement, the housing of the lamp containing the heat dissipation device is a standard lamp size.

In a second embodiment of the invention, an LED lamp includes a heat dissipation disk in thermal connection with at least one LED in the lamp, a reflector dish having at least one surface area enhancement feature in thermal connection with the heat dissipation disk, a heat pipe in thermal connection with the heat dissipation disk, and a housing containing the heat dissipation disk, reflector dish and heat pipe. The surface enhancement features improve thermal management in the lamp without altering its form factor.

In one arrangement, the at least one surface area enhancement feature is a ripple in the reflector dish. In a second alternative arrangement, the reflector dish has a rim and the at least one surface area enhancement feature is a plurality of flanges extending from the rim of the reflector dish. In a third alternative arrangement, the at least one surface area enhancement feature is a plurality of ripples in the reflector dish.

In a still further alternative arrangement, the housing is thermally conductive. In another arrangement, the heat dissipation disk, reflector dish and heat pipe are mounted in the housing with thermally conductive adhesive. In another arrangement, the housing is a standard lamp size. In a still further alternative arrangement, the reflector dish is uncovered during lamp operation. This leaves the reflector dish exposed to the air further enhancing heat dissipation from the LEDs.

The present invention together with the above and other advantages may best be understood from the following detailed description of the embodiments of the invention illustrated in the drawings, wherein:

DRAWINGS

DESCRIPTION

A heat dissipation apparatus for a light emitting diode (LED) lamp includes passive heat dissipation elements that enable the LED lamp to meet form factor standards while managing heat to optimize operation and lifespan of the LEDs.

Figure 1:
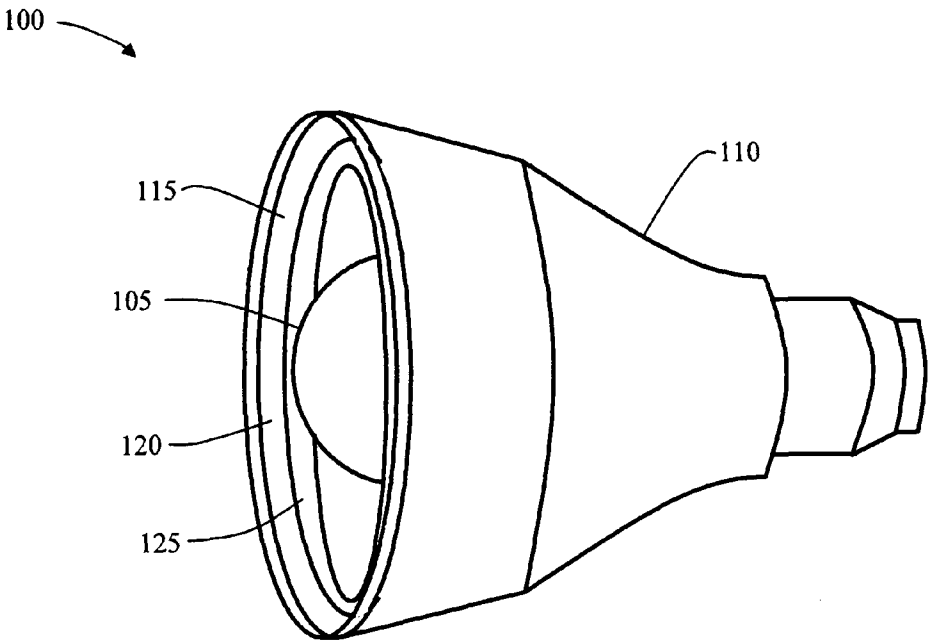
FIG. 1 is a perspective view of a lamp with a heat dissipation apparatus according to principles of the invention.
Figure 3:
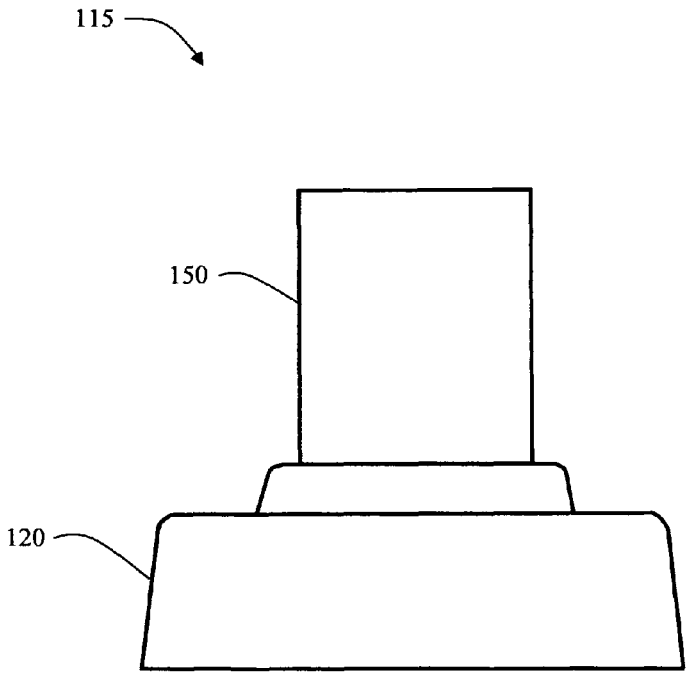
FIG. 3 is a side view of the heat dissipation apparatus according to one embodiment.

FIG. 1 is a perspective view of a lamp assembly 100 including a heat dissipation apparatus (also referred to as a heat dissipation device) according to the invention. The lamp assembly 100 is suitable for use as a solid-state lamp such as an LED lamp. The lamp assembly 100 includes a generally conically-shaped housing 110 also referred to as a "shell". LEDs are located under a light-transmissive cover 105 that is substantially axially-centered inside the housing 110. The housing 110 further contains the heat dissipation apparatus 115. The heat dissipation apparatus 115 includes a reflector dish 120 located inside the housing and encircling the LEDs. The reflector dish 120 has a surface area enhancement feature. In the present embodiment, the surface area enhancement feature is a single ripple 125 that encircles the LEDs. The heat dissipation apparatus further includes a heat pipe which is shown in FIG. 3 and will be further described below. The reflector dish 120 and heat pipe are thermally conductive. The reflector dish and heat pipe are, for example, made of metal. In one arrangement, the support structure for the LEDs (not shown) and the reflector dish are secured inside the housing with thermally conductive adhesive. The adhesive is, for example, thermal adhesive SG916 which is thermally conductive and electrically insulating. In another arrangement, the housing 110 is also thermally conductive.

In operation, the LEDs generate heat. The LEDs are in thermal contact with the heat dissipation apparatus 115 which passively dissipates the heat. The ripple 125 in the reflector dish 120 increases the surface area of the reflector dish 120 and thereby increases its heat dissipation capacity over a non-rippled reflector dish. Further, the rippled reflector dish 120 enables the heat dissipation apparatus to have increased surface area without increased the diameter of the lamp assembly. This arrangement enables the lamp assembly 100 to conform to established lamp standards while improving heat dissipation. The heat pipe inside the assembly provides a thermally conductive path which further increases heat dissipation by the heat dissipation apparatus 115.

Figure 2:
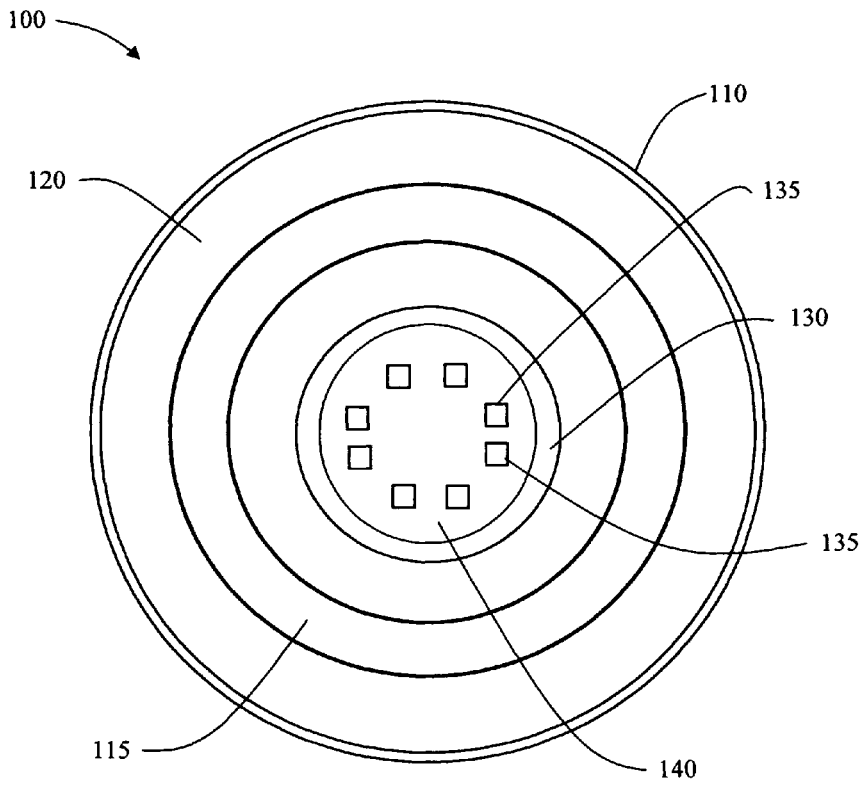
FIG. 2 is a top view of a lamp with the heat dissipation apparatus of FIG. 1.

FIG. 2 is a top view of the lamp assembly with the heat dissipation apparatus. LEDs 135 for light generation are mounted on a support structure 140 such as a printed circuit board, or printed wiring board, that is substantially centered in the housing 110. The housing 110 has, for example, a maximum diameter of 4.5", which is a lighting industry form factor standard. The support structure 140 is mounted on and in thermal connection with a heat dissipation disk 130. The heat dissipation disk 130 is mounted in and is in thermal connection with the heat dissipation apparatus 115 which is mounted inside the lamp housing 110. The heat dissipation apparatus 115 includes the reflector dish 120 that is substantially concentric with the heat dissipation disk 130 inside the housing 110. The reflector dish 120 is rippled to increase its surface area. In the present embodiment, a ripple 125 encircles the heat dissipation disk 130. Not seen in this view, but shown in FIG. 1, is a light transmissive cover that covers the LEDs 135 and the support structure 140 while leaving the reflector dish 120 exposed to the air.

In operation, the LEDs generate heat. The LEDs are in thermal contact with the heat dissipation apparatus 115 which is in thermal contact with the housing 110. Eventually the LED leads, heat dissipation apparatus and housing reach substantial temperature equilibrium and heat dissipates from the lamp surface area. The ripple 125 in the reflector dish 120 increases the surface area of the reflector dish 120 and thereby increases its heat dissipating capacity over a non-rippled reflector dish. Further, the rippled reflector dish 120 enables the heat dissipation apparatus 115 to have increased surface area without increasing the diameter of the lamp assembly. This arrangement enables the lamp assembly to conform to established standards while improving heat dissipation. The heat pipe inside the assembly provides a thermally conductive path which further increases heat dissipation by the heat dissipation apparatus.

FIG. 3 is a side view of the heat dissipation apparatus according to one embodiment. The heat dissipation apparatus 115 includes the reflector dish 120 as described above with regard to FIGS. 1 and 2. The heat dissipation apparatus 115 further includes a heat pipe 150. The reflector dish 120 and heat pipe 150 are formed and configured to fit inside the lamp housing 110 (shown in FIGS. 1, 2 and 3). The ripple in the reflector dish 120 increases the surface area of the heat dissipation apparatus 115 without increasing its diameter. Accordingly, the form factor of the lamp assembly 100 is maintained. Therefore, the heat dissipation apparatus can be used to improve the heat dissipation capacity in standard lamp forms. Further, the heat pipe 150 is in thermal contact with the LEDs 135 and provides a thermal path for the heat generated by the LEDs 135.

Figure 4:
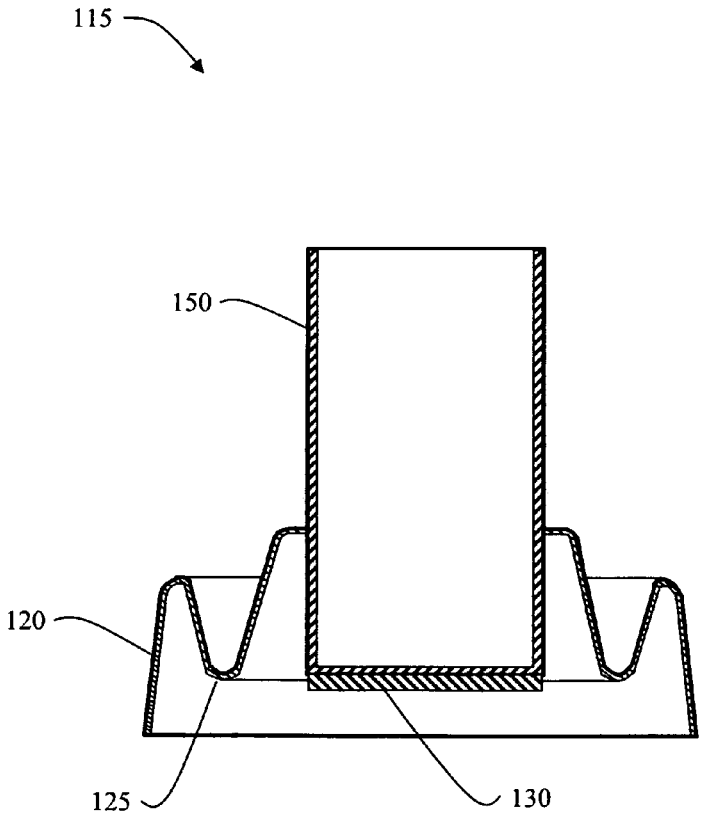
FIG. 4 is a side cross-sectional view of the heat dissipation apparatus of FIG. 3.
Figure 7:
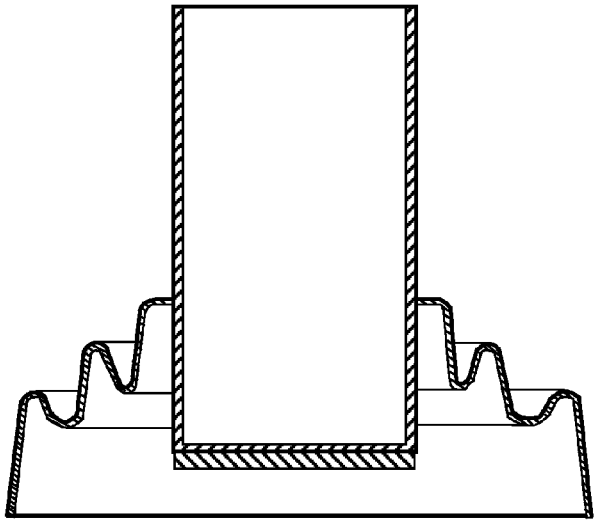
FIG. 7 is a side cross-sectional view of a heat dissipation apparatus.

FIG. 4 is a side cross-sectional view of the heat dissipation apparatus 115. The heat dissipation apparatus 115 includes the reflector dish 120 as described above. The reflector dish 120 has a wavy shape and includes the ripple 125 that is substantially axially centered in the reflector dish 120. The heat dissipation apparatus 115 further includes a heat pipe 150. The heat pipe 150 is in thermal contact with the heat dissipation disk 130. The heat dissipation disk 130 is in thermal contact with the LEDs 135 (shown in FIG. 2) and provides an additional thermal path along with the reflector dish for dissipation of the heat generated by the LEDs 135. In a first alternative embodiment, the heat dissipation disk 130 and heat pipe 150 are one piece. In a second alternative embodiment, the reflector dish includes more than one ripple (shown in FIG. 7). FIG. 7 shows a heat dissipation device for an LED lamp having a heat dissipation disk in thermal connection with at least one LED in the lamp; a reflector dish having at least one surface area enhancement feature in thermal connection with the heat dissipation disk, wherein the at least one surface area enhancement feature is a plurality of ripples in the reflector dish; and, a heat pipe in thermal connection with the heat dissipation disk.

Figure 5:
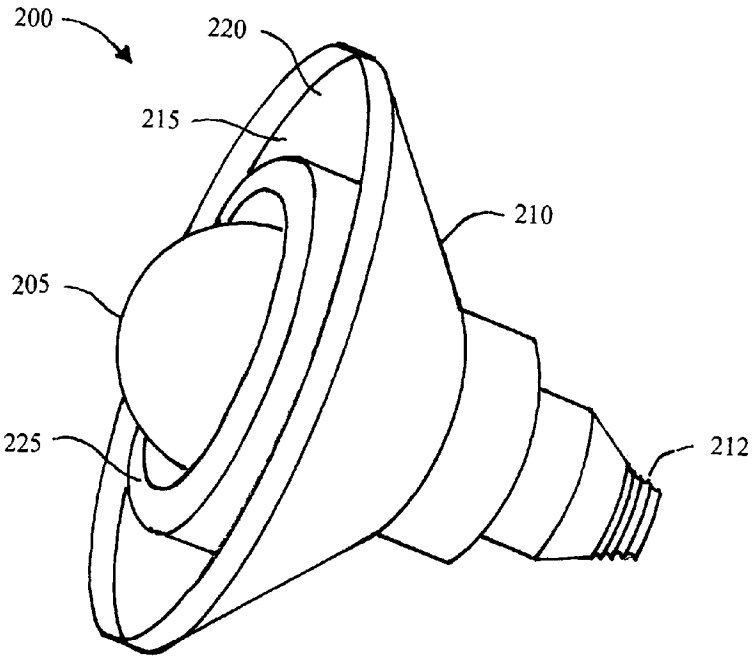
FIG. 5 is a perspective view of an alternative embodiment of a lamp with a heat dissipation apparatus according to principles of the invention.

FIG. 5 is a perspective view of an alternative embodiment of a solid-state lamp with a heat dissipation apparatus. The lamp 200 includes a generally conically-shaped housing 210 or shell and a standard lamp base 212. LEDs are located under a light-transmissive cover 205 that is substantially axially-centered inside the housing 210. The housing 210 further contains the heat dissipation apparatus 215. The heat dissipation apparatus 215 includes a reflector dish 220 located inside the housing and encircling the LEDs. The reflector dish 220 is rippled. In this arrangement, a single ripple 225 encircles the LEDs. In this embodiment, the housing 210 has an alternate shape and the ripple 225 has a larger amplitude than the arrangement described above. The heat dissipation apparatus 215 further includes a heat pipe similar to that described in the embodiment above. The reflector dish 220 and heat pipe are thermally conductive. The reflector dish and heat pipe are, for example, made of metal. In one arrangement, the support structure for the LEDs (not shown) and the reflector dish are secured inside the housing with thermally conductive adhesive.

In operation, the LEDs generate heat. The LEDs are in thermal contact with the heat dissipation apparatus which passively dissipates the heat. The ripple 225 in the reflector dish 220 increases the surface area of the reflector dish 220 and thereby increases its heat dissipating capacity over a non-rippled reflector dish. The rippled reflector dish 220 enables the heat dissipation apparatus to have increased surface area without increased the diameter of the lamp. This arrangement enables the lamp to conform to established standards while improving heat dissipation. The heat pipe inside the assembly provides a thermally conductive path which further increases heat dissipation by the heat dissipation apparatus.

Figure 6:
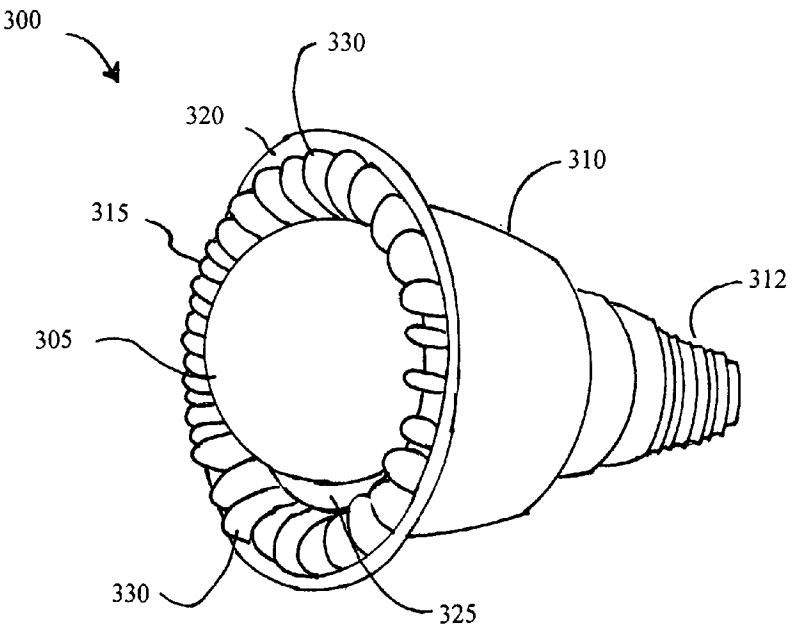
FIG. 6 is a perspective view of a second alternative embodiment of a lamp with a heat dissipation apparatus according to principles of the invention.

FIG. 6 is a perspective view of a second alternative embodiment of a lamp with a heat dissipation apparatus according to principles of the invention. The lamp 300 includes a generally conically-shaped housing 310 and a standard lamp base 312. LEDs are located under a light-transmissive cover 305 that is substantially axially-centered inside the housing 310. The housing 310 further contains the heat dissipation apparatus 315. The heat dissipation apparatus 315 includes a reflector dish 320 located inside the housing 310 and encircling the LEDs. The reflector dish 320 has a number of surface area enhancement features. A first surface area enhancement feature is a ripple 325 encircling the LEDs. Further in this arrangement, a number of flanges 330 extend inward from the rim of the reflector dish 320 in the space between the ripple 325 and the rim. The heat dissipation apparatus 315 further includes a heat pipe (not shown). The reflector dish 320 and heat pipe are thermally conductive. The reflector dish 320 and heat pipe are, for example, made of metal. In one arrangement, the support structure for the LEDs (not shown) and the reflector dish are secured inside the housing with thermally conductive adhesive.

In operation, the LEDs generate heat. The LEDs are in thermal contact with the heat dissipation apparatus which passively dissipates the heat. The ripple 325 in the reflector dish 320 increases the surface area of the reflector dish 320 and thereby increases its heat dissipating capacity over a non-rippled reflector dish. The rippled reflector dish 320 enables the heat dissipation apparatus to have increased surface area without increased the diameter of the lamp assembly. This arrangement enables the lamp assembly to conform to established standards while improving heat dissipation. The heat pipe inside the assembly provides a thermally conductive path which further increases heat dissipation by the heat dissipation apparatus.

It is to be understood that the above-identified embodiments are simply illustrative of the principles of the invention. Various and other modifications and changes may be made by those skilled in the art which will embody the principles of the invention and fall within the spirit and scope thereof.

I claim:

1. A heat dissipation device for an LED lamp, comprising:
- a heat dissipation disk in thermal connection with at least one LED in the lamp;
- a reflector dish having at least one surface area enhancement feature in thermal connection with the heat dissipation disk, wherein the at least one surface area enhancement feature is a ripple in the reflector dish; and,
- a heat pipe in thermal connection with the heat dissipation disk.

2. An LED lamp, comprising:
- a heat dissipation disk in thermal connection with at least one LED in the lamp;
- a reflector dish having at least one surface area enhancement feature in thermal connection with the heat dissipation disk, wherein the reflector dish has a rim and the at least one surface area enhancement feature is a plurality of flanges extending from the rim of the reflector dish;
- a heat pipe in thermal connection with the heat dissipation disk; and,
- a housing containing the heat dissipation disk, reflector dish and heat pipe.

3. A heat dissipation device for an LED lamp, comprising:
- a heat dissipation disk in thermal connection with at least one LED in the lamp;
- a reflector dish having at least one surface area enhancement feature in thermal connection with the heat dissipation disk, wherein the reflector dish has a rim and the at least one surface area enhancement feature is a plurality of flanges extending from the rim of the reflector dish; and,
- a heat pipe in thermal connection with the heat dissipation disk.

4. A heat dissipation device for an LED lamp, comprising:
- a heat dissipation disk in thermal connection with at least one LED in the lamp;
- a reflector dish having at least one surface area enhancement feature in thermal connection with the heat dissipation disk, wherein the at least one surface area enhancement feature is a plurality of ripples in the reflector dish; and,
- a heat pipe in thermal connection with the heat dissipation disk.

5. The heat dissipation device of claim 1 further comprising a thermally conductive housing containing the heat dissipation disk, reflector dish and heat pipe.

6. The heat dissipation device of claim 5 wherein the heat dissipation disk, reflector dish and heat pipe are mounted in the housing with thermally conductive adhesive.

7. The heat dissipation device of claim 5 wherein the housing is a standard lamp size.

8. The heat dissipation device of claim 1 wherein the reflector dish is uncovered during lamp operation.

9. An LED lamp, comprising:
- a heat dissipation disk in thermal connection with at least one LED in the lamp;
- a reflector dish having at least one surface area enhancement feature in thermal connection with the heat dissipation disk;
- a heat pipe in thermal connection with the heat dissipation disk, wherein the at least one surface area enhancement feature is a ripple in the reflector dish; and
- a housing containing the heat dissipation disk, reflector dish and heat pipe.

10. An LED lamp, comprising:
- a heat dissipation disk in thermal connection with at least one LED in the lamp;
- a reflector dish having at least one surface area enhancement feature in thermal connection with the heat dissipation disk, wherein the at least one surface area enhancement feature is a plurality of ripples in the reflector dish
- a heat pipe in thermal connection with the heat dissipation disk; and,
- a housing containing the heat dissipation disk, reflector dish and heat pipe.

11. The LED lamp of claim 9 wherein the housing is thermally conductive.

12. The LED lamp of claim 11 wherein the heat dissipation disk, reflector dish and heat pipe are mounted in the housing with thermally conductive adhesive.

13. The LED lamp of claim 9 wherein the housing is a standard lamp size.

14. The LED lamp of claim 9 wherein the reflector dish is uncovered during lamp operation.

15. The heat dissipation device of claim 3 further comprising a thermally conductive housing containing the heat dissipation disk, reflector dish and heat pipe.

16. The heat dissipation device of claim 15 wherein the heat dissipation disk, reflector dish and heat pipe are mounted in the housing with thermally conductive adhesive.

17. The heat dissipation device of claim 15 wherein the housing is a standard lamp size.

18. The heat dissipation device of claim 4 further comprising a thermally conductive housing containing the heat dissipation disk, reflector dish and heat pipe.

19. The heat dissipation device of claim 18 wherein the heat dissipation disk, reflector dish and heat pipe are mounted in the housing with thermally conductive adhesive.

20. The heat dissipation device of claim 18 wherein the housing is a standard lamp size.

* * * * *